United States Patent [19]

Stoeckli

[11] Patent Number: 4,832,654

[45] Date of Patent: May 23, 1989

[54] APPARATUS FOR DIAMETER-DEPENDENT SORTING OF DISK-SHAPED ARTICLES, PARTICULARLY COINS

[76] Inventor: Rudole Stoeckli, Gallusstrasse 36, 4600 Olten, Switzerland

[21] Appl. No.: 934,993

[22] Filed: Nov. 26, 1986

[30] Foreign Application Priority Data

Nov. 28, 1985 [CH] Switzerland ..... 05083/85

[51] Int. Cl.[4] ..... G07D 3/12

[52] U.S. Cl. ..... 453/7; 453/56; 453/58

[58] Field of Search ..... 453/3, 5, 7, 9, 11, 453/56, 58, 63; 209/656, 658, 659

[56] References Cited

U.S. PATENT DOCUMENTS

| | | | |
|---|---|---|---|
| 2,337,942 | 12/1943 | Shuman | 209/656 X |
| 2,570,395 | 10/1951 | Siegal | 209/658 X |
| 4,072,156 | 2/1978 | Abe | 453/11 |
| 4,088,144 | 5/1978 | Zimmermann | 453/11 |
| 4,135,529 | 1/1979 | Onoe et al. | 453/5 |
| 4,178,502 | 12/1979 | Zimmermann | 453/9 X |
| 4,226,254 | 10/1980 | Mouri et al. | 453/11 |
| 4,230,135 | 10/1980 | Ueda | 453/11 |
| 4,261,377 | 4/1981 | Ueda | 453/11 |
| 4,271,855 | 6/1981 | Ueda | 453/11 |

FOREIGN PATENT DOCUMENTS

| | | | |
|---|---|---|---|
| 2413240 | 10/1976 | Fed. Rep. of Germany | 453/7 |
| 2547685 | 4/1977 | Fed. Rep. of Germany . | |
| 2713844 | 9/1978 | Fed. Rep. of Germany . | |
| 2737352 | 3/1979 | Fed. Rep. of Germany . | |
| 2900873 | 7/1980 | Fed. Rep. of Germany . | |
| 3325486 | 1/1984 | Fed. Rep. of Germany . | |
| 16-24966 | 12/1941 | Japan . | |
| 53-49492 | 9/1951 | Japan . | |
| 42869 | 5/1923 | Norway | 209/658 |

*Primary Examiner*—Joseph J. Rolla
*Assistant Examiner*—Edward S. Ammeen
*Attorney, Agent, or Firm*—Hill, Van Santen, Steadman & Simpson

[57] ABSTRACT

The disk shaped articles or coins to be sorted are conveyed by an entrainment belt on a base plate in conveying direction along a guide rail. Dependent on their diameter, the coins are separated out of the conveying path at respectively one of the sorting stations. The outward transfer ensues by a high-speed sorting belt into whose sphere of influence the coins respective proceed when, as a consequence of their diameter, they are lifted off from the base plate at one side due to their inherent motion in conveying direction, being lifted off by means of a wedge-shaped deflection element. The sorting belt then withdraws the coin to be transferred out of the conveying path under high acceleration, so that it proceeds into a collecting shaft. Such as apparatus functioning with an exclusively mechanical arrangement allows a high sorting speed given a compact structure.

9 Claims, 2 Drawing Sheets

APPARATUS FOR DIAMETER-DEPENDENT SORTING OF DISK-SHAPED ARTICLES, PARTICULARLY COINS

BACKGROUND OF THE INVENTION

1. Field of the Invention

The invention relates to an apparatus for sorting disk-shaped articles such as coins by diameter size, including a conveying path following upon an isolation means, bridged by an endless entrainment belt and laterally limited by a guide rail with at least one sorting station being arranged along the conveying path.

2. Description of the Prior Art

In such an apparatus as described above, the entrainment belt lying on the coins supplied from the isolating means serves the purpose of conveying the coins on a base plate along the guide rail. Given an apparatus of the type disclosed by German Pat. No. 27 13 844, the sorting stations include sorting openings in a row in the base plate graduated in width based on increasing diameters of the coins to be sorted. Although this known apparatus is simple in structure, a sorting speed limited to only about 2000 coins per minute is possible because of the time required for the coins to fall through the sorting openings in free fall. Further, it cannot be excluded in the known apparatus that, due to bridge formation between a preceeding and a following coin, a middle coin will be prevented from falling through the sorting opening allocated to it, so that it proceeds into the wrong collecting container.

The disadvantage described above can be at least partially eliminated by lengthening the sorting openings. Such an apparatus, however, would make use of an excessive structural length which would have an especially disadvantageous effect given a larger number of coin denominations to be sorted.

SUMMARY OF THE INVENTION

The invention is based on an object of creating an apparatus of the type described above which enables a higher operating speed without an increase in structural length.

The solution of the stated object in accord with the invention succeeds on the basis of having every sorting station along the conveying path include a deflection element dimensioned for a predetermined diameter whose deflection face projects into the entrainment region of a drivable sorting element conveying transversely relative to the conveying path. With exclusively mechanical means, the solution of the invention enables a significantly higher sorting speed than the known apparatus and, moreover, is more reliable due to the constrained guidance of the coins ensuing by means of the sorting belt. The coins deflected by the deflection element in the direction of the sorting element are pulled out from under the entrainment belt at a right angle thereto with great acceleration due to the running sorting element. A compact structure of the apparatus of the invention is possible as a result of avoiding longer sorting openings in the form of drop spaces.

In an embodiment of the invention, the coin to be separated out of the conveying path is lifted up at one side by the ramp-like deflection element in order to proceed into the entrainment region of the sorting element.

The invention also contemplates that it is possible to convey the article to be sorted along a sorting path proceeding at a right angle relative to the conveying path. The sorting belt is thereby preferably driven at such a speed that the article to be sorted is quickly accelerated out of the region of the conveying path. The sprung deflection roller thereby guarantees a reliable seizing even of articles having different thicknesses.

An embodiment of the invention provides that only a single drive is required for the overall apparatus insofar as this also drives the isolating means. Such an isolating means is adequately known, for example from German Pat. Nos. 25 47 685 and 27 13 844. This prior art is referenced for the illustration and specification of such isolation means.

Although the base plate can be arranged horizontally, an inclined base plate can also be utilized which assures that the articles conveyed along the conveying path lie against the guide rail. The base plate can thereby be arranged at a greater or lesser pitch.

The apparatus embodying the invention separates out foreign coins whose diameters lie between those of the coins to be sorted. In such an apparatus, every sorting station includes a foreign currency shaft, whereby, however, all foreign currency shafts can lead into a common foreign currency collecting container.

Alternatively, in accord with the invention, foreign coins are recognized and separated out before they proceed into the conveying path to the sorting stations. As a result thereof, it is also possible to consider not only the diameter but also other criteria of the foreign coins.

In an alternative embodiment the coins recognized as foreign coins are conveyed through the entire conveying path regardless of their dimensions in order to be collected in a single container at the end of the conveying path.

A further alternative embodiment does not burden the conveying path with foreign coin recognition, since this is assigned to the sorting stations. Such an embodiment seems advantageous when, for example, the apparatus is constructed of individual elements in accord with customer desires, so that a separation of foreign coins can also be optionally foregone.

Finally the present invention ensures that the articles to be sorted are reliably seized even given a relatively high conveying speed of the entrainment belt.

BRIEF DESCRIPTION OF THE DRAWINGS

An exemplary embodiment of the invention shall be set forth in greater detail with reference to the drawings.

DESCRIPTION OF THE PREFERRED EMBODIMENTS

Figure 1:
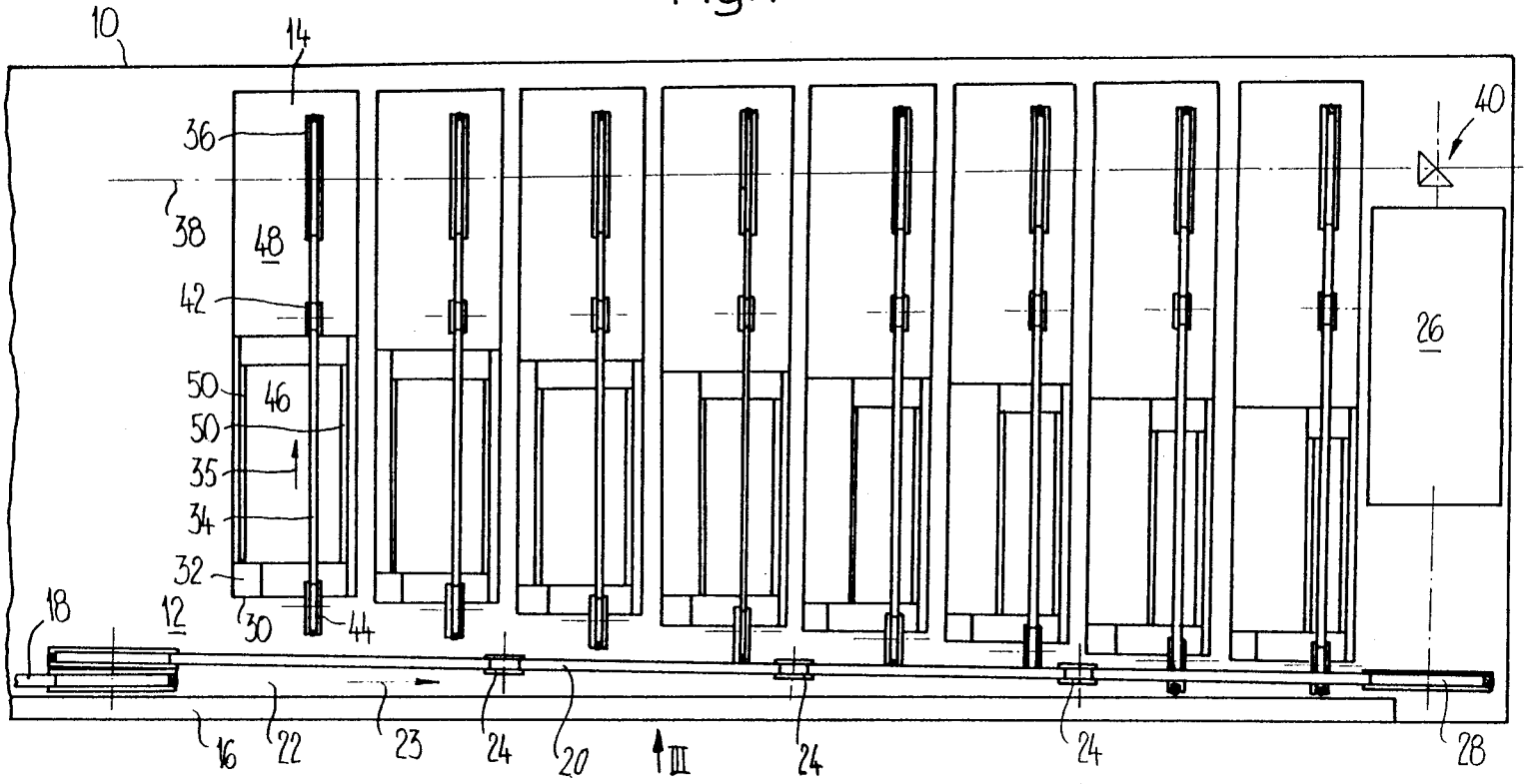
FIG. 1 is a plan view of a sorting apparatus particularly intended for coins.

An apparatus shown in FIG. 1 includes a frame 10 having a base plate 12 on which 8 sorting stations 14 are arranged in the present exemplary embodiment.

From the aforementioned known and therefore not illustrated isolating apparatus, the articles are supplied along a guide rail 16 by means of a feeder belt 18 and are subsequently conveyed by an entrainment belt 20 for conveying along a conveying path 22 proceeding parallel to the guide rail 16. The underside of the entrainment belt 20 is held down by pressure rollers 24 spaced in uniform intervals in order to guarantee a reliable entrainment of the articles, particularly coins to be sorted on the base plate 12 along the guide rail 16.

A drive 26 which is coupled to a drive roller 28 wrapped by the entrainment belt 20 serves for the drive of the entrainment belt 20 as well as of the feeder belt 18.

Lying opposite the guide rail 16, each of the sorting stations 14 includes a deflection element 30 in the conveying path 22, the deflection element 30 including a deflection face 32 proceeding rising in ramp-like fashion in a conveying direction 23. Of the sorting stations 14 arranged in a row, the first as seen in the conveying direction 23, is intended for the coins having the largest diameter and the last is intended for the coins having the smallest diameter. The sorting stations lying therebetween are intended for the intermediate sizes. The distance between the guide rail 16 and the deflection element 30 is dimensioned for each sorting station 14 such that it is smaller than the diameter of the coins to be separated out at the appertaining sorting station but is at least equal to or greater than the diameter of the coins to be allowed to pass. As a result thereof, the coins to be separated out from the conveying path 22 at each sorting station 14 are lifted up at one side at this station while being conveyed by the entrainment belt 20, being lifted up at one side in order to proceed into the region of a sorting element 34 in the form of a sorting belt. On the basis of this sorting belt 34 having its underside driven in a sorting direction 35, the coins lifted up by the deflection element 30 are conveyed away at a right angle relative to the conveying path 22.

Via a respective, drivable deflection roller 36 and a common shaft 38, the sorting belts 34 of all sorting stations 14 are coupled to the drive 26 by means of an angular gear arrangement 40. The sorting belts 34 are held taut by respective tension rollers 42 which press against the upper side of the belt. The deflection roller 44 arranged opposite the drivable deflection roller 36 is situated above the deflection element 30 and is resiliently arranged relative thereto.

A foreign currency shaft or slot 46 and a collecting shaft or slot 48 intended for the coins to be sorted are arranged in sequence on the conveying path extending in the sorting direction 35. The opening of the foreign currency shaft 46 is limited by lateral guide rails 50. The guide rails 50 having an angular profile are dimensioned such that the coin to be sorted is reliably guided thereon up to the collecting shaft 48 but such that smaller coins fall into the foreign currency shaft 46.

Figure 2:
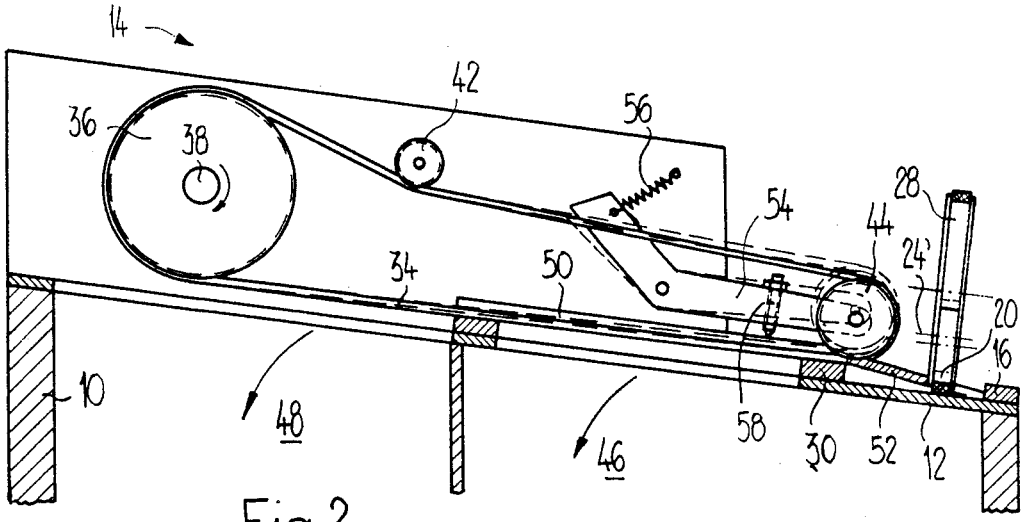
FIG. 2 illustrates the apparatus of FIG. 1 in cross section.

The cross-section shown in FIG. 2 shows how a coin 52 lying against the guide rail 16 at the right side has its left side lifted up by the deflection element 30, so that it proceeds into the sphere of influence of the sorting belt 34 which wraps the deflection roller 44 in that region, this deflection roller 44 being seated at the end of a lever 54 and residing under the influence of a tension spring 56. The position of the lever 54 is adjustable by means of a set screw 58 in order, for example, to undertake an adaptation to the thickness of the coins to be separated out in this sorting station. Reference numeral 24' indicates the axial shaft of the pressure roller 24 in FIG. 2.

FIG. 2 shows an angle of inclination of the base plate 12 which is preferred in order to cause the coins 52 to lie against the guide rail 16 for easier diameter identification when entrained by the entrainment belt 20. However, it is also possible to arrange the base plate 12 with a greater or lesser slope or to also arrange it horizontally.

Figure 3:
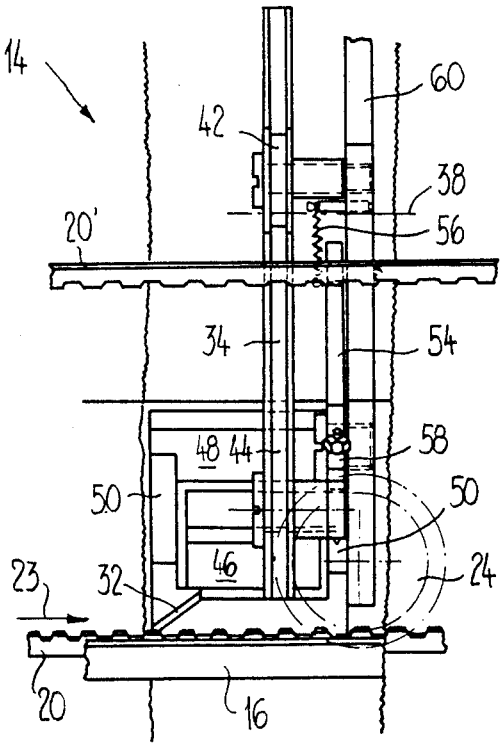
FIG. 3 is a front view of the apparatus of FIG. 1 as indicated by arrow III.

FIG. 3 shows a front view of the apparatus in the direction of arrow III in FIG. 1. For easier recognition of the individual elements, however, FIG. 3 is an enlarged view. The returning side of the entrainment belt 20 is referenced with the reference numeral 20' in FIG. 3. A partition 60 separates two sorting stations 14 neighboring one another.

In contrast to the embodiment shown in FIG. 1, and as shown in FIG. 4, it is also possible to recognize the foreign currency overall with a foreign currency recognition means 62 and to eliminate it in the first sorting station. In such a case, the foreign currency shafts or slots 46 and the lateral guide rails 50 are superfluous. The collecting shaft intended for the coins to be sorted can be arranged at that location at which the foreign currency shaft 46 is shown in the illustrated exemplary embodiment of FIG. 1. The foreign currency recognition means 62 is arranged preceding the sorting station 14 and a further sorting station 64 intended for foreign coins is arranged ahead of the sorting station 14 and includes a deflection element 66 which can be moved into a conveying path 22 dependent on a coin recognized as a foreign coin.

For example, it is also possible by means of a single sorting station to supply coins of a specific value to a stacking means (not shown) for packaging.

An apparatus for sorting coins is usually connected to a counting means at every sorting station, an illustration thereof having been foregone in the present exemplary embodiment since such counting devices are known from the prior art.

It is also possible to supply the coins of a specific currency to be sorted to the described apparatus only after foreign currency has been separated out, so that the foreign currency separating devices set forth above are eliminated.

In a further, modified embodiment, foreign coins can also be guided along the conveying path to a collecting container, for which purpose, for example, the deflection elements can be rendered ineffective such as by retracting them, when a foreign coin passes by.

In the sorting operation, the sorting element 34 pulls the coins out of the conveying path 22 of FIG. 1 in fractions of a second. The high sorting speed is possible as a result of such a constrained guidance of the coins. Far more than 2000 coins per minute can thereby be processed.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An apparatus for sorting disk-shaped articles, such as coins and the like, according to the diameter thereof, including an article isolating means, a conveying path arranged downstream of said article isolating means, an endless entrainment belt extending along and arranged above said conveying path, a guide rail extending along said conveying path for laterally limiting the latter, at least one sorting station arranged along said conveying path, said sorting station comprising a deflection element positioned at a distance from said guide rail smaller than a predetermined diameter of the articles to be sorted out at said sorting station and provided with a deflection face arranged to act upon said articles and to deflect such articles out of said conveying path, said sorting station further comprising a drivable sorting element for entraining the articles acted upon by said deflection element and to convey these articles in a conveying direction extending transversely to said conveying path, said sorting element being positioned at a distance above said conveying path.

2. An apparatus according to claim 1, wherein said deflection element lies opposite the guide rail and its spacing from the guide rail is smaller than the predetermined diameter of the articles to be separated out at the appertaining sorting station but is at least of the same size or greater than the diameter of articles to be allowed to pass; and wherein at least a portion of its deflection face rises ramp-like in the direction of the conveying path.

3. An apparatus according to claim 1, wherein said sorting element comprises a sorting belt wrapping at least two deflection rollers and extending transversely relative to the conveying path in that one deflection roller is positioned above the deflection element and is spring biased in the direction of the deflection element and in that the other deflection roller is connected to a drive means.

4. An apparatus according to claim 3, which includes a plurality of sorting stations, wherein the drivable deflection rollers of all sorting stations are arranged on a common shaft and in that the drive means are connected to said shaft and also coupled to a drive roller of the entrainment belt.

5. An apparatus according to claim 1, wherein said sorting element is a roller arranged in a region of the deflection element and mounted to resiliently move in the direction of the deflection element, said roller at least having an exposed surface of an elastic material

6. An apparatus according to claim 1, wherein the conveying path is arranged on a base plate downwardly declined in the direction towards the guide rail.

7. An apparatus according to claim 3, for sorting coins, wherein a foreign currency shaft and a collecting shaft intended for the coins to be sorted are successively arranged in sorting direction below the sorting path defined by and extending along the sorting belt and in that the sorting path includes an opening limited by lateral guide rails in the region above the foreign currency shaft, the width of said opening being smaller than the diameter of the coins to be collected in the allocated sorting station but being greater than the diameter of the coins to be allowed to pass the deflection element of the same sorting station.

8. An apparatus according to claim 1, for sorting coins, wherein a foreign coinage recognition means is arranged preceding the sorting station and in that a further sorting station intended for foreign coins is arranged ahead of said sorting station and includes a deflection element which can be moved into the conveying path dependent on a coin recognized as a foreign coin.

9. An apparatus according to claim 1, wherein the entrainment belt has a side facing the conveying path, which side is held down by pressure rollers arranged in spaced relationship and residing under spring power.

* * * * *